US010577761B2

(12) United States Patent
Grimm et al.

(10) Patent No.: US 10,577,761 B2
(45) Date of Patent: Mar. 3, 2020

(54) SYSTEM AND METHOD FOR APPLYING MULTI-COLORED SURFACE MARKINGS TO A SURFACE

(71) Applicant: Capstan Ag Systems, Inc., Topeka, KS (US)

(72) Inventors: Jeffrey J. Grimm, Holton, KS (US); Troy C. Kolb, Hiawatha, KS (US)

(73) Assignee: Capstan Ag Systems, Inc., Topeka, KS (US)

( * ) Notice: Subject to any disclaimer, the term of this patent is extended or adjusted under 35 U.S.C. 154(b) by 22 days.

(21) Appl. No.: 15/429,431

(22) Filed: Feb. 10, 2017

(65) Prior Publication Data

US 2017/0152637 A1 Jun. 1, 2017

Related U.S. Application Data

(63) Continuation of application No. 14/048,786, filed on Oct. 8, 2013, now Pat. No. 9,598,826.

(60) Provisional application No. 61/720,132, filed on Oct. 30, 2012.

(51) Int. Cl.
*B05D 1/02* (2006.01)
*E01C 23/22* (2006.01)

(52) U.S. Cl.
CPC ..... *E01C 23/222* (2013.01); *B05D 1/02* (2013.01)

(58) Field of Classification Search
None
See application file for complete search history.

(56) References Cited

U.S. PATENT DOCUMENTS

| | | | | |
|---|---|---|---|---|
| 2,997,064 A | | 8/1961 | Gerwig et al. | |
| 3,120,927 A | | 2/1964 | Holland | |
| 5,169,262 A | | 12/1992 | Wilson et al. | |
| 5,203,923 A | | 4/1993 | Hartman | |
| 5,225,239 A | * | 7/1993 | Ostin | B05B 12/1418 118/683 |
| 5,294,798 A | | 3/1994 | Hartman | |
| 5,312,043 A | | 5/1994 | Whitney | |

(Continued)

OTHER PUBLICATIONS

Notice of Acceptance for Australian Patent Application No. 2013248190, dated Apr. 19, 2016, 2 pages.

(Continued)

*Primary Examiner* — Charles Capozzi
(74) *Attorney, Agent, or Firm* — Armstrong Teasdale LLP

(57) ABSTRACT

In one aspect, a system for applying painted surface markings to roads, parking lots, fields and/or any other suitable surfaces is disclosed. The system may include a plurality of valves and associated spray nozzles mounted onto and/or within a manifold, with each valve being individually controllable in order to regulate the flow of paint being dispensed from the spray nozzles. For instance, a controller may be coupled to each valve in order to control the opening and closing of such valve, thereby controlling the flow of paint supplied to the corresponding spray nozzle. In addition, information regarding the surface marking to be applied (the design, dimensions, orientation, geographical location, etc.) may be stored within and/or received by the controller. The controller may then control each valve such that paint is applied to the surface to be marked via the spray nozzles in a manner that creates the desired surface marking.

20 Claims, 11 Drawing Sheets

(56) References Cited

U.S. PATENT DOCUMENTS 5,368,232 A 11/1994 Schroeder
5,371,531 A * 12/1994 Rezanka ..... B41J 2/2107 347/100
5,544,972 A 8/1996 Boldt
5,599,133 A 2/1997 Costello et al.
5,707,689 A * 1/1998 Hori ..... B05C 5/0279 347/1
5,829,679 A * 11/1998 Strong ..... B05B 7/0408 239/117
5,947,385 A 9/1999 Lanerd et al.
6,010,179 A 1/2000 McGoldrick
6,021,959 A 2/2000 Mayfield, Jr. et al.
6,047,902 A 4/2000 Hofmann
6,074,693 A 6/2000 Manning
6,126,088 A 10/2000 Wilger et al.
6,152,382 A 11/2000 Pun
6,183,161 B1 2/2001 Neeper
6,213,680 B1 4/2001 Schaeffer et al.
6,299,934 B1 * 10/2001 Manning ..... B05B 12/12 342/357.34
6,413,012 B1 7/2002 Jones
6,505,995 B2 1/2003 Sanfilippo et al.
6,511,259 B1 1/2003 Khieu et al.
6,547,158 B1 4/2003 Smith
6,702,516 B1 3/2004 Harrison
6,729,706 B1 5/2004 Patton et al.
6,796,740 B2 9/2004 Chiron et al.
6,810,150 B1 * 10/2004 Akimoto ..... H04N 1/33307 382/232
6,913,417 B2 7/2005 Lind et al.
7,021,860 B1 4/2006 Bolstad
7,029,199 B2 4/2006 Mayfield et al.
7,066,680 B2 6/2006 Wiley
7,150,413 B1 12/2006 Bricko et al.
7,237,783 B2 7/2007 Kieffer et al.
7,294,204 B2 11/2007 Hong et al.
D560,271 S 1/2008 Kesti et al.
7,367,515 B1 5/2008 Newman
7,429,146 B2 9/2008 Hall et al.
7,449,068 B2 11/2008 Lichtblau et al.
7,611,076 B1 11/2009 Street et al.
7,654,774 B1 2/2010 Jarred et al.
7,806,626 B2 10/2010 Malit
7,850,101 B2 12/2010 Walmer
7,866,917 B2 1/2011 Malit
7,975,935 B2 7/2011 Matheis, Jr.
7,975,981 B2 7/2011 Harrison, Jr.
7,977,429 B2 7/2011 Nagai et al.
7,978,935 B2 7/2011 Grunder
7,985,473 B2 7/2011 Hayakawa et al.
7,988,075 B2 8/2011 Altenburger
7,988,106 B2 8/2011 Carnevali
7,994,079 B2 8/2011 Chen et al.
7,998,242 B2 8/2011 Reiffel
8,001,730 B2 8/2011 Wallance
8,010,048 B2 8/2011 Brommer et al.
8,013,238 B2 9/2011 Hockaday
8,016,213 B2 9/2011 Altenburger
8,021,077 B2 * 9/2011 Annese ..... E01C 23/222 118/305
8,022,119 B2 9/2011 Andreas et al.
8,024,995 B2 9/2011 Dayton et al.
8,025,389 B2 9/2011 Yamanobe et al.
8,029,258 B2 10/2011 Khoshnevis
8,034,173 B2 10/2011 Dietz
8,034,309 B2 10/2011 Tsujimichi et al.
8,043,654 B2 10/2011 Russell et al.
8,048,517 B2 11/2011 Kimball et al.
8,051,637 B2 11/2011 Labrador
8,052,070 B2 11/2011 Bakken
8,054,065 B2 11/2011 Targosz
8,057,530 B2 11/2011 Kusleika et al.
8,061,295 B2 11/2011 Zimmerman et al.
8,062,098 B2 11/2011 Duescher
8,062,418 B2 11/2011 Constantz et al.
8,062,710 B2 11/2011 Kurth et al.
8,067,059 B2 11/2011 Birger
8,101,780 B2 1/2012 Saxell et al.
8,105,401 B2 1/2012 Neves et al.
8,105,692 B2 1/2012 Dumm et al.
8,110,037 B2 2/2012 Russell et al.
8,114,214 B2 2/2012 Constantz et al.
8,119,583 B2 2/2012 Day et al.
8,124,672 B2 2/2012 Reisacher et al.
8,128,243 B2 3/2012 Lynam
8,128,244 B2 3/2012 Lynam
8,132,741 B2 3/2012 Tremblay, Jr. et al.
8,133,645 B2 3/2012 Inagaki et al.
8,137,444 B2 3/2012 Farsad et al.
8,137,455 B1 3/2012 Constantz et al.
8,143,331 B2 3/2012 Raymond et al.
8,147,077 B2 4/2012 Lynam
8,151,687 B2 4/2012 Hall
8,152,862 B2 4/2012 Carlson et al.
8,160,497 B2 4/2012 Brommer et al.
8,160,782 B2 4/2012 Harrison, Jr.
8,164,817 B2 4/2012 Varaprasad et al.
8,169,684 B2 5/2012 Bugno et al.
2001/0002229 A1 5/2001 Schaeffer et al.
2003/0168834 A1 9/2003 Ulrich
2005/0048199 A1 3/2005 Thompson et al.
2005/0263613 A1 * 12/2005 Beck ..... B05B 7/2472 239/304
2008/0061168 A1 * 3/2008 Scheidt ..... B29B 7/7663 239/428
2008/0189038 A1 8/2008 Hole et al.
2010/0032492 A1 2/2010 Grimm et al.
2011/0266357 A1 11/2011 Orcutt et al.
2012/0228395 A1 * 9/2012 Needham ..... F16K 31/0606 239/11
2013/0236644 A1 * 9/2013 Logan ..... B66F 9/12 427/299

OTHER PUBLICATIONS

Patent Examination Report No. 2 for Australian Patent Application No. 2013248190, dated Dec. 23, 2015, 4 pages.
Patent Examination Report No. 1 for Australian Patent Application No. 2013248190, dated Jul. 27, 2015, 4 pages.

* cited by examiner

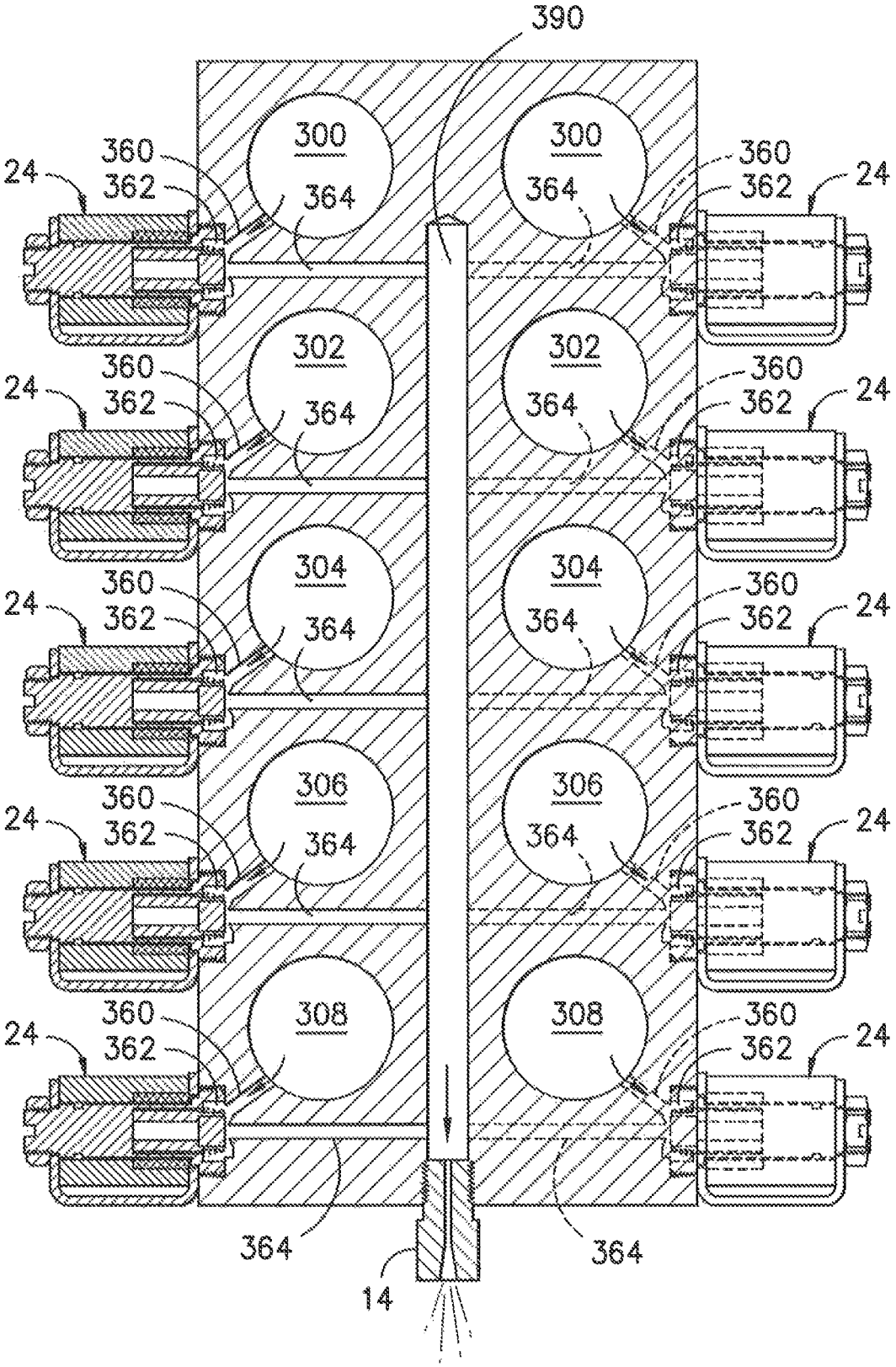
FIG. —9—

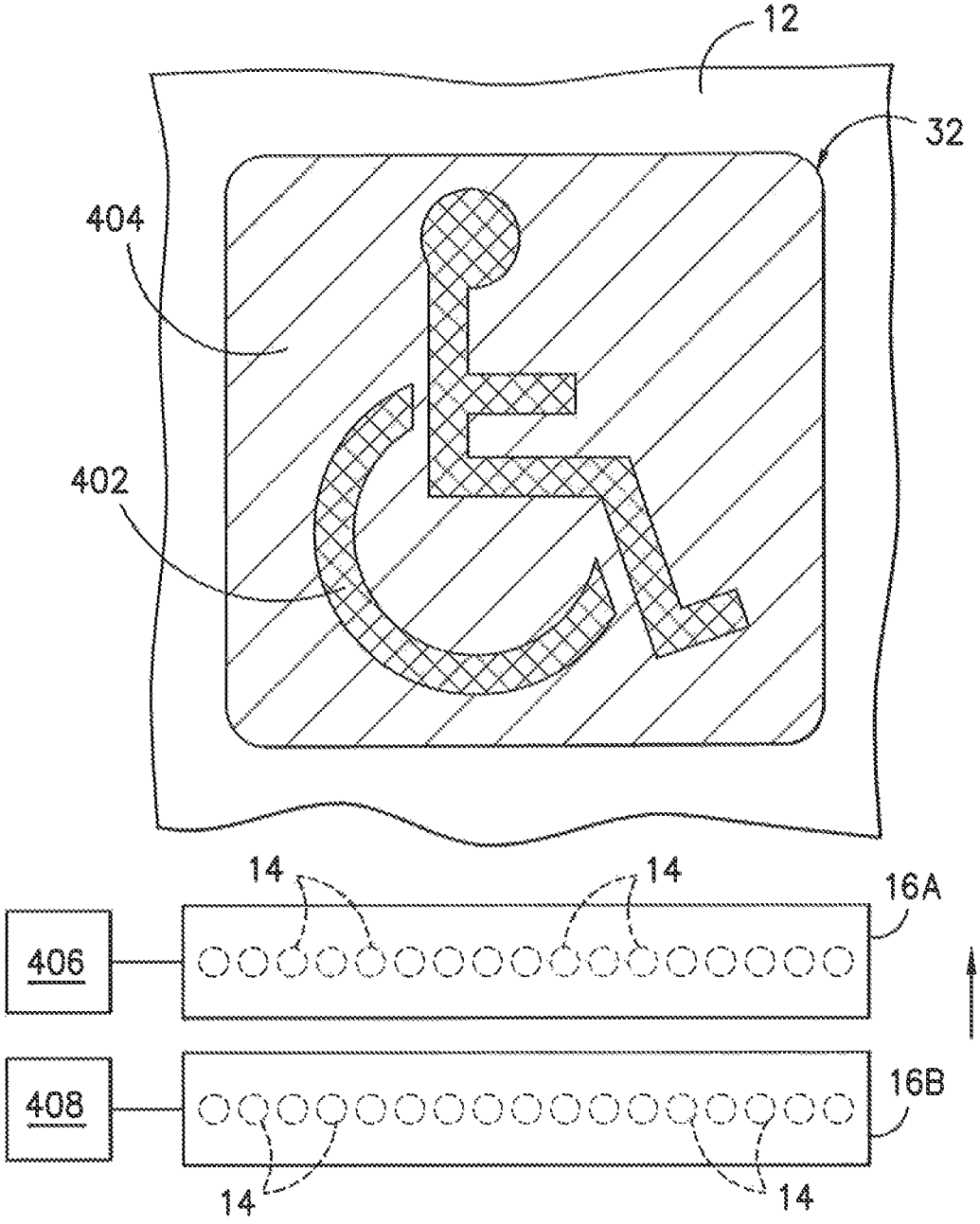
FIG. —10—

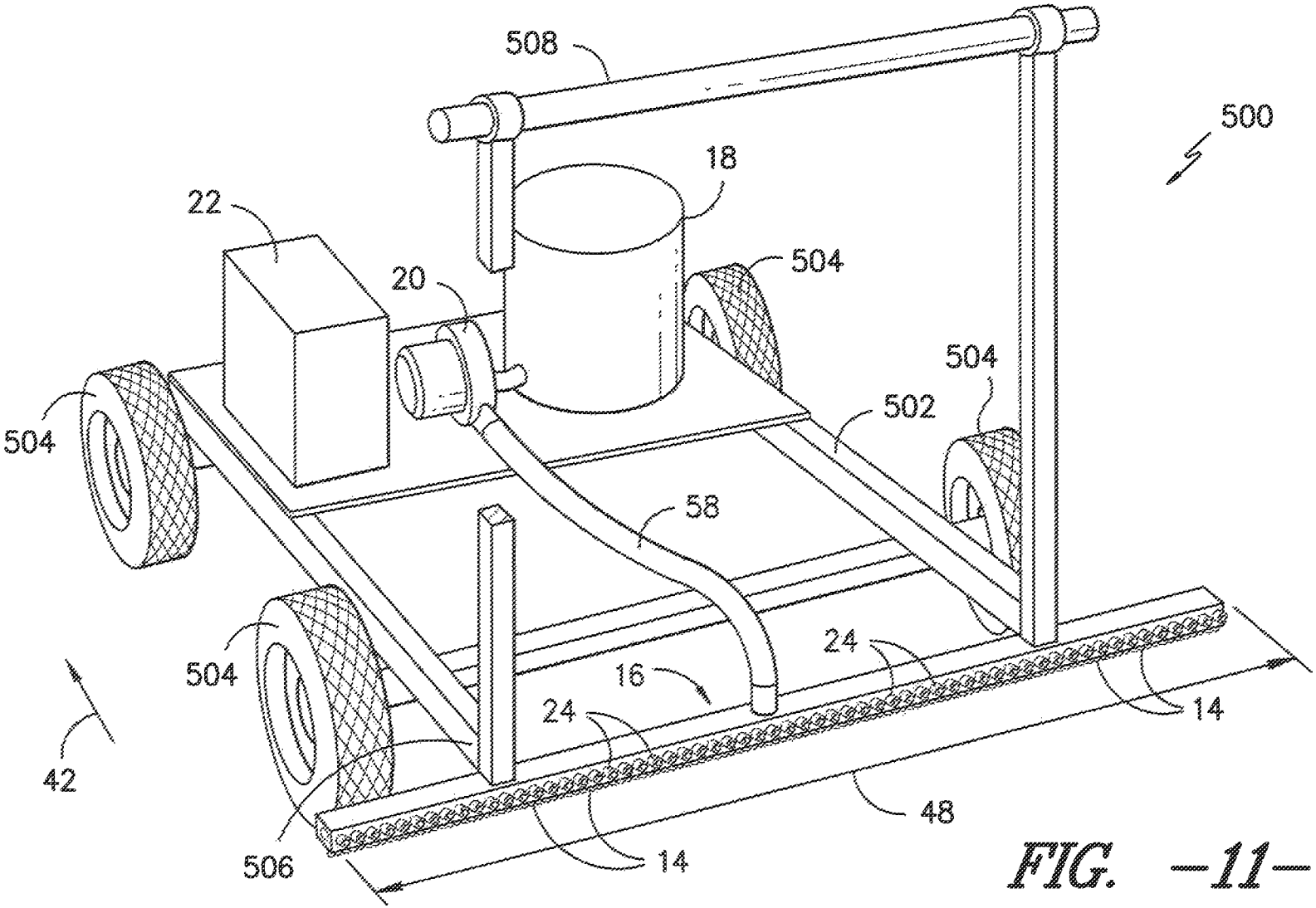
FIG. —11—

SYSTEM AND METHOD FOR APPLYING MULTI-COLORED SURFACE MARKINGS TO A SURFACE

CROSS-REFERENCE TO RELATED APPLICATIONS

This application is a continuation of U.S. patent application Ser. No. 14/048,786, filed on Oct. 8, 2013, which claims priority to U.S. Provisional Application No. 61/720,132 filed on Oct. 30, 2012, the disclosures of which are hereby incorporated by reference in their entirety for all purposes.

FIELD OF THE INVENTION

The present subject matter relates generally to paint spraying systems and, more particularly, to systems and methods for painting surface markings on roads, parking lots, fields and/or other surfaces.

BACKGROUND OF THE INVENTION

Surface markings are used in various settings to convey information. For example, surface markings, such as lines, stripes, arrows, words, symbols and/or the like, are often provided on roadways to provide drivers road-related information (e.g., lane boundaries, stopping points, warning signs, turn lane designations and/or the like). Similarly, surface markings, such as numbers, words and/or designs, may be provided in parking lots to identify specific parking spots (e.g., handicapped and/or numbered parking spots). In addition, surface markings may also be provided on sports fields to identify team names, team logos, boundaries, affiliations (e.g., conference logos) and/or the like.

Typically, complex surface markings, such as words, numbers, logos, designs and/or other images, are applied to a surface using pre-manufactured templates. For instance, to apply a logo onto a sports field, a template corresponding to a negative image of the logo may be initially placed onto the field. Thereafter, the portions of the field visible through the template may be manually painted (e.g., by hand painting or spray painting the logo). As such, the use of templates to create surface markings is typically a very labor intensive and time consuming process.

Moreover, it is often the case that the templates used to create surface markings cannot be reused until the paint applied to such templates has dried, which can be very problematic when a large number of repetitive surface markings must be created. For instance, number templates are typically used to create numbered parking places in parking lots. In such instances, once a given template has been used to create a single numbered parking place, the template may not be used again until the paint sprayed or otherwise applied across the template has dried. Thus, to mark a plurality of different parking places, a significant amount of time and/or templates is required.

Accordingly, a system and method for automatically applying painted surface markings to a surface would be welcomed in the art.

BRIEF DESCRIPTION OF THE INVENTION

Aspects and advantages of the invention will be set forth in part in the following description, or may be obvious from the description, or may be learned through practice of the invention.

Various embodiments of a system and method for painting surface markings on a given surface, such as a road, parking lot, field and/or the like, are disclosed.

In one aspect, the present subject matter is directed to a system for applying surface markings to a surface. The system may include a manifold defining a common passage configured to receive a marking fluid. The manifold may further define a plurality of pairs of inlet channels and outlet channels. Each inlet channel may be in fluid communication with the common passage. A plurality of valves may be coupled to the manifold such that a valve cavity is defined between each valve and the manifold. Each valve cavity may be configured to be in fluid communication with one of the pairs of inlet and outlet channels. Additionally, a plurality of spray nozzles may be coupled to the manifold. Each spray nozzle may be in fluid communication with one of the outlet channels such that, when the valve is moved to an opened position, the marking fluid flows from the valve cavity through the corresponding outlet channel and into the spray nozzle. The system may also include a controller communicatively coupled to the valves. The controller may be configured to independently control the operation of each valve so as to regulate the flow of marking fluid supplied to each spray nozzle, wherein the flow of marking fluid supplied to each spray nozzle is regulated such that the marking fluid is discharged from the spray nozzles in a manner that generates a desired surface marking across an area of the surface being marked.

In this aspect, the system may also include a position sensor communicatively coupled to the controller. The position sensor may be configured to provide information associated with the position of each spray nozzle as the manifold is moved relative to the surface being marked Also in this aspect, the position sensor may comprise at least one of a wheel encoder, a GPS receiver or a camera Further in this aspect, the controller may be configured to receive a pixel data map associated with the desired surface marking. The controller may be further configured to correlate the pixel data map to the area of the surface being marked In this aspect, the pixel data map may be correlated to the area of the surface being marked by scaling the pixel data map based on the dimensions of the desired surface marking to be applied across the area.

Also in this aspect, the pixel data map may comprise a plurality of mapped pixels. The controller may be configured to correlate each pixel to a location along the area of the surface being marked.

Further in this aspect, the controller may be configured to control the operation of the valves based on the position information provided by the position sensor such that marking fluid is discharged from each spray nozzle at a location along the area of the surface being marked corresponding to a location on the pixel data map that contains a colored portion of the desired surface marking In this aspect, the manifold may extend lengthwise between a first end and a second end and the common passage being defined through both the first and second ends.

Also in this aspect, an end cap may be disposed at both the first end and the second end of the manifold. The end caps may be configured to prevent the marking fluid from being expelled from the common passage at the first and second ends.

Further in this aspect, the manifold may comprise a first manifold and the system may include a second manifold. The first and second manifolds being configured to be assembled end-to-end such that the common passage of the first manifold is in fluid communication with the common passage of the second manifold In this aspect, the spray nozzles may be coupled to the manifold along a bottom face of the manifold and the manifold may include a first side and a second side extending from the bottom face. Additionally, the valves may be coupled to the manifold along the first and second sides in an alternating arrangement such that the valves associated with adjacent spray nozzles are positioned on opposed sides of the manifold.

Also in this aspect, the marking fluid supplied within the manifold may be received from a non-pressurized container. For example, the marking fluid may be pumped into the manifold from the non-pressurized container Further in this aspect, the marking fluid supplied within the manifold may be received from a pressurized container.

In this aspect, the manifold may define a plurality of common passages. Each of the common passages may be configured to receive a different colored paint.

Also in this aspect, the system may include a movable cart configured to support the manifold.

Further in this aspect, the marking fluid may comprise paint.

In this aspect, the surface marking may comprise a two-dimensional image.

Also in this aspect, the surface may comprise a road, a parking lot, a field, a wall or any other suitable surface.

In another aspect, the present subject matter is directed to a system for applying multi-colored surface markings to a surface. The system may include a manifold defining a plurality of common passages. Each common passage may be configured to receive a different colored marking fluid. The manifold may also define an inlet channel and an outlet channel associated with each common passage. Each inlet channel may be in direct fluid communication with one of the common passages. The manifold may further define a mixing passage in fluid communication with each of the outlet channels. A plurality of valves may be coupled to manifold such that a valve cavity is defined between each valve and the manifold. Each valve cavity may be configured to be in fluid communication with the inlet channel and the outlet channel associated with one of the common passages. Additionally, a spray nozzle may be coupled to the manifold. The spray nozzle may be in fluid communication with the mixing passage such that, when one of the valves is moved to an opened position, marking fluid from the valve cavity associated with the valve flows through the mixing passage and into the spray nozzle. The system may also include a controller communicatively coupled to the valves. The controller may be configured to independently control the operation of each valve such that two or more of the different colored marking fluids are supplied to and mixed within the mixing passage to create a new colored marking fluid to be discharged from the spray nozzle.

In a further aspect, the present subject matter is directed to a method for applying multi-colored surface markings to a surface using a first manifold configured to receive a first colored marking fluid and a second manifold configured to receive a second colored marking fluid. The first and second manifolds may each include a plurality of spray nozzles and a plurality of valves. Each valve may be configured to regulate the flow of marking fluid from one of the spray nozzles. The method may include receiving a pixel data map associated with a desired surface marking to be applied across an area of the surface, wherein the surface marking includes a first portion to be applied using the first colored marking fluid and a second portion to be applied using the second colored marking fluid. In addition, the method may include scaling the pixel data map based on the dimensions of the desired surface marking, controlling the operation of the valves of the first manifold as the first manifold is moved along the surface such that the first colored marking fluid is discharged from the spray nozzles of the first manifold in a manner that generates the first portion of the desired surface marking across the surface and controlling the valves of the second manifold as the second manifold is moved along the surface such that the second colored marking fluid is discharged from the spray nozzles of the second manifold in a manner that generates the second portion of the desired surface marking across the surface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 9 illustrates a cross-sectional view of a further embodiment of a manifold that may be utilized with the disclosed system, particularly illustrating the manifold including a plurality of different passages configured to receive different colored paints;

FIG. 10 illustrates a simplified view of another embodiment of a pixel data map including data corresponding to a surface marking to be applied to a given surface, particularly illustrating an embodiment of the disclosed system in which a multi-colored surface marking may be applied using two or more manifolds, with each manifold receiving a different colored paint; and FIG. 11 illustrates a perspective view of one embodiment of a movable cart that may be used to support the various components of the disclosed system.

DETAILED DESCRIPTION OF THE INVENTION

Figure 1:
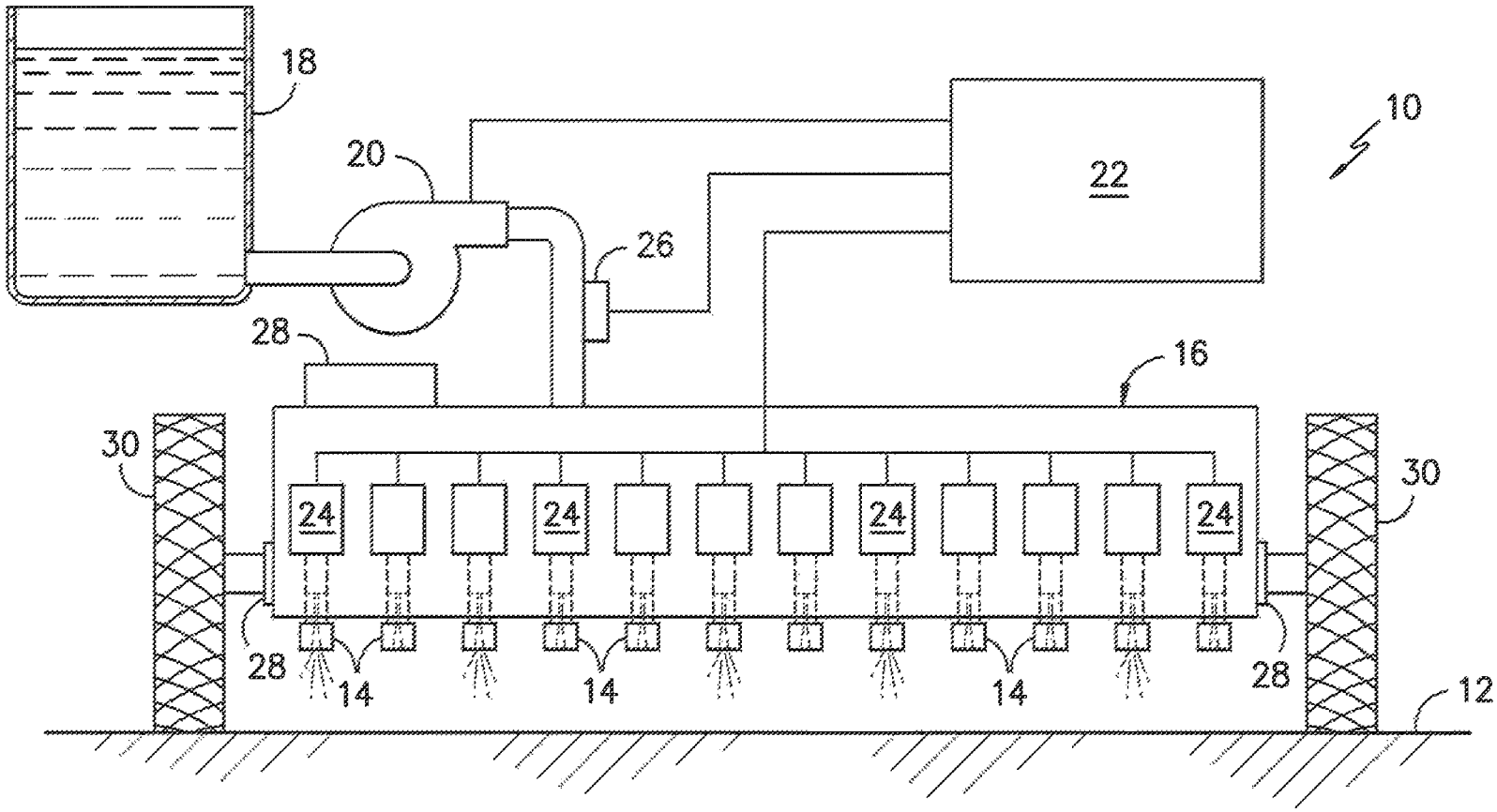
FIG. 1 illustrates a simplified, schematic view of one embodiment of a system for applying surface markings to a surface in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a system for applying painted surface markings to roads, parking lots, fields and/or any other suitable surfaces. In several embodiments, the system may include a plurality of valves and associated spray nozzles mounted onto and/or within a manifold, with each valve being individually controllable in order to regulate the timing, flow rate, droplet size and/or other parameters of the paint being dispensed from the spray nozzles. For instance, a controller may be coupled to each valve in order to control the opening and closing of such valve, thereby controlling the flow of paint supplied to the corresponding spray nozzle. In such an embodiment, information regarding the surface marking to be applied (design, dimensions, orientation, geographical location, etc.) may be stored within and/or received by the controller. The controller may then control each valve such that paint is applied to the surface to be marked (hereinafter also referred to as the "marking surface") via the spray nozzles in a manner that forms the desired surface marking.

It should be appreciated that, as used herein, the term "surface marking" refers to any suitable marking that may be painted or otherwise applied to a given marking surface. For example, surface markings may include, but are not limited to, markings, (e.g., lines, stripes, words, numbers, logos, signs, arrows, OSHA symbols, other indicia and/or the like) that are applied to a road, parking lot, sidewalk, field, track, airplane runway, taxiway, factory floor and/or other any other surface across which vehicles and/or persons traverse. For instance, in a particular embodiment, surface markings may include, but are not limited to, the lines, numbers, words, logos, designs and/or other images or indicia (including pictures) that are typically applied to a sports field, such as a football, baseball and/or soccer field. Similarly, surface markings may include, but are not limited to, markings applied onto the surface of a sign, billboard, wall, building, water tower, roadside curb and/or the like. For example, in another particular embodiment, surface markings may include, but are not limited to, words, numbers, logos, designs, marketing or advertising indicia (e.g., bar codes and/or quick response (QR) codes) and/or the like that may be applied to the side of a building or any other surface.

It should also be appreciated that, although the present subject matter will be described herein as using the disclosed system to spray paint onto a marking surface, the system may generally be utilized to spray any suitable fluid(s) capable of creating a surface marking, such as dyes, pigments and/or other marking fluids.

Referring now to the drawings, FIG. 1 illustrates a simplified, schematic view of one embodiment of a system 10 for applying surface markings to a suitable marking surface 12, such as a road, parking lot, field, wall or other surface. As shown, the system 10 generally includes a plurality spray nozzles 14 mounted onto and/or formed integrally with a boom or manifold 16. The manifold 16 may generally be configured to receive paint or any other suitable marking fluid from a container 18 (e.g., a tank or other non-pressurized reservoir and/or a pressurized container) For instance, as shown in FIG. 1, a suitable pump 20 may be provided between the manifold 16 and the container 18. As such, paint from the container 18 may be pumped into the manifold 16 for subsequent discharge through the spray nozzles 14.

It should be appreciated that the spray nozzles 14 may generally have any suitable nozzle and/or spray tip configuration known in the art. For instance, in one embodiment, the spray nozzles 14 may be configured as a flat fan tip, cone tip, straight stream tip and/or any other suitable spray nozzle and/or tip known in the art.

To control the discharge of paint from the spray nozzles 14, the disclosed system 10 may also include a controller 22 configured to independently control a plurality of valves 24 mounted onto and/or within the manifold 16. Specifically, in several embodiments, each spray nozzle 14 may be in fluid communication with one of the valves 24 so that the flow of paint into and through each spray nozzle 14 is regulated by its corresponding valve 24. In such embodiments, the controller 22 may be configured to control the operation of each valve 24 so as to provide for independent control of the paint discharged from each spray nozzle 14.

It should be appreciated that the valves 24 may generally have any suitable valve configuration known in the art. For instance, in several embodiments, the valves 24 may be configured as latching solenoid valves, 2WNC solenoid valves, pilot actuated solenoid valves, flipper solenoid valves and/or the like. By configuring the valves 24 as solenoid valves, the valves 24, together with the controller 22, may provide for pulse width modulation (PWM) based control of the flow rate of the paint supplied to each spray nozzle 14. For instance, the controller 22 may be configured to supply a regulated current (e.g., via a driver) to the solenoid coil 78 (FIG. 5) of each valve 24 in order to pulse the valve 24 at a given duty cycle. Thus, by controlling the duty cycle at which each valve 24 is pulsed, the controller 22 may control the flow rate of paint to each spray nozzle 14.

Additionally, as shown in FIG. 1, the controller 22 may also be communicatively coupled to the pump 20 to allow for automatic control of the pressure of the paint supplied to the manifold 16. For instance, the controller 22 may be configured to receive pressure measurements from a pressure sensor 26 disposed downstream of the pump 20 and, based on such measurements, control the pressure of the paint supplied to the manifold 16. Such pressure control may generally allow for control of the droplet size spectrum of the paint discharged from the spray nozzles 14, as such droplet size is typically a function of the fluid pressure and the characteristics of the spray nozzle 14.

It should be appreciated that the controller 22 may generally comprise any suitable computer and/or other processing unit, including any suitable combination of computers, processing units and/or the like that may be operated independently or in connection within one another. Thus, in several embodiments, the controller 22 may include one or more processor(s) and associated memory device(s) configured to perform a variety of computer-implemented functions (e.g., performing the calculations disclosed herein). As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) of the controller 22 may generally comprise memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) may generally be configured to store suitable computer-readable instructions that, when implemented by the processor(s), configure the controller 22 to perform various functions including, but not limited to, controlling the operation of the valves 24 and/or the pump 20 and/or various other suitable computer implemented functions.

Referring still to FIG. 1, the disclosed system 10 may also include one or more position sensors 28 configured to provide the controller 22 with an indication of the actual or relative position of the manifold 16 and, thus, the actual or relative position of the spray nozzles 14 positioned on the manifold 16. For example, in one embodiment, the position sensor(s) 28 may comprise one or more wheel sensors or encoders configured to provide an indication of the position of the manifold 16 and/or the spray nozzles 14 relative to a starting or reference position. Specifically, as shown in FIG. 1, the manifold 16 may be mounted on a frame (not shown) supported by a plurality of wheels 30. In such an embodiment, a wheel encoder(s) may be associated with one or more of the wheels 30 to provide an indication of the relative position of the manifold 16 and/or spray nozzles 14 by monitoring the distance traveled by the Wheels 30 from the starting or reference location. In another embodiment, the position sensor(s) 28 may comprise one or more global positioning satellite (GPS) receivers configured to provide an indication of the actual and/or relative position of the manifold 16 and/or spray nozzle(s) 14. For instance, the GPS receiver(s) may be configured to receive positioning data from a plurality of different satellites, which may then be correlated by the controller 22 (or the GPS receiver) to the three-dimensional coordinates of the manifold 16 and/or spray nozzle(s) 14. In such an embodiment, the GPS receiver(s) may be configured to provide real time kinematic (RTK) data to allow for enhanced accuracy of the satellite positioning data (e.g., centimeter accuracy).

In other embodiments, the position sensor may comprise any other suitable sensor(s) and/or other device(s) capable of providing an indication of the actual or relative position of the manifold 16 and/or the spray nozzles 14. For example, in a further embodiment, a camera and/or other vision system may be used to detect the position of the manifold 16. In such an embodiment, the controller 22 may be provided with suitable image processing algorithms/software to allow the images captured by the camera to be analyzed in a manner that permits the relative and/or actual position of the manifold 16 to be determined. For instance, the camera may be disposed at a distal location relative to the manifold 16 such that images may be captured of the manifold as it moves across the marking surface 12. Alternatively, the camera may be mounted directly to the manifold 16 such that images of the environment surrounding the manifold 16 may be captured in order to allow for the actual and/or relative position of the manifold 16 to be determined. It should be appreciated that, when the camera is mounted to the manifold 16, the camera may also be used to detect surface markings. For example, the camera may be configured to capture images of stripes previously marked on a highway. In such an embodiment, the controller 22 may be configured to analyze the images to determine the location of each stripe and, based on such determination, control the valves 24 such that new stripes are painted over the old stripes.

In another embodiment, the position sensor(s) 28 may form all or a part of any suitable positioning system known in the art, such as a laser, sonar and/or radar positioning system. For example, a laser emitting device may be disposed at a distal location relative to the manifold 16 and a corresponding reflector and/or receiver may be mounted onto the manifold 16. In such an embodiment, the laser emitting device may emit a beam of light that is reflected and/or detected by the reflector/detector. Thereafter, the travel time of the light may be analyzed to determine the position of the manifold 16 relative to the laser emitting device.

Regardless of the type of position sensor(s) 28 used, the position information provided by such sensor(s) 28 may generally be utilized by the controller 22 to control the operation of each valve 24. For example, a print file or pixel data map (e.g., a bitmap car pixmap) may be stored within and/or received by the controller 22 that includes mapped data corresponding to a desired surface marking. This pixel data map may then be correlated to the area across which the surface marking is to be applied. For instance, the dimensions of the pixel data map may be scaled to the corresponding area of the marking surface 12. Thereafter, as the manifold 16 is moved across the marking surface 12, the controller 22 may individually control the valves 24 based on the position information such that each valve 24 is activated as it passes over a location on the marking surface 12 at which paint is to be applied.

Figure 2:
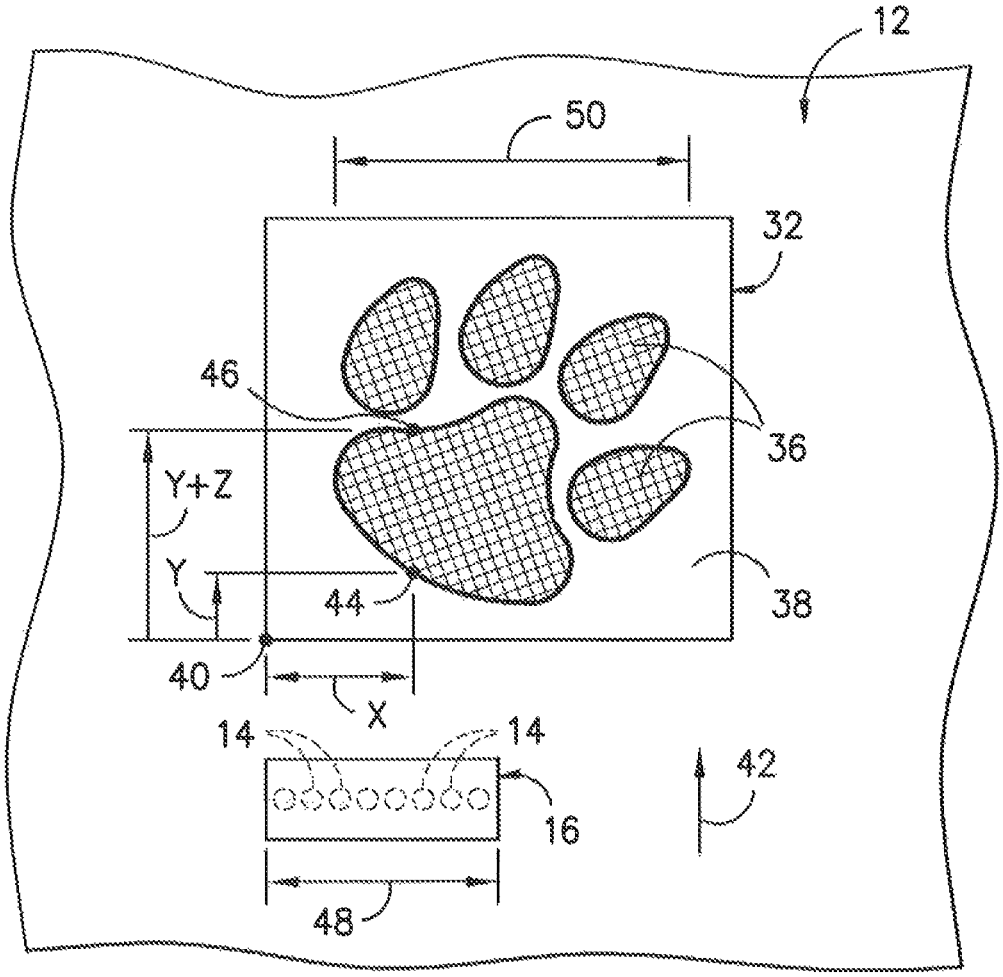
FIG. 2 illustrates a simplified view of one embodiment of a pixel data map including data corresponding to a surface marking to be applied to a given surface.

For example, FIG. 2 illustrates an example of a pixel data map 32 superimposed over a given marking surface 12 (e.g., a field), with the pixel data map 32 mapping a surface marking (e.g., a sports logo) that is to be applied onto the surface 12. As is generally understood, the pixel data map 32 may correspond to a spatially mapped array of pixels, with each pixel being assigned a value corresponding to the color associated with such pixel. For example, as shown in illustrated embodiment, the pixel data map 32 includes a shaded portion 36 (i.e., the portion of the map 32 that is to be painted a specific color) and a non-shaded portion 38 (i.e., the portion of the map 38 that is to remain un-painted). In such an embodiment, assuming that the shaded portion 36 only includes a single color, each pixel contained within the pixel data map 32 may be assigned one of two bit values, such as a zero for each pixel contained within the non-shaded portion 38 and a one for each pixel contained within the shaded portion 36. Of course, it should be appreciated that the amount of data stored within the pixel data map 32 may depend on the number of colors included within a particular surface marking. For example, for surface markings including a plurality of different colors, the pixel data map 32 may be a palleted bit map or any other suitable multi-colored bit map and, thus, may support any number of colors across the RGB color scale or the CYM color scale (e.g., 256 different colors).

In one embodiment, to apply the surface marking shown in FIG. 2, the controller 22 may be configured to scale the pixel data map 32 based on the desired dimensions of the surface marking and the resolution capabilities of the disclosed manifold 16 (which may depend on the spacing of the spray nozzles 14). For instance, assuming that the dimensions with the pixel data map 32 must be 10 feet by 10 feet to achieve the desired dimensions for the surface marking (i.e., the shaded portion 36 of FIG. 2) and the system 10 has a resolution of 5 pixels per inch, the scaled pixel data map 32 may be 600 pixels high by 600 pixels wide. This scaled pixel data map 32 may then be utilized by the controller 22, along with the position information provided by the position sensor(s) 28, to control the valves 24 in a manner that permits the desired surface marking to be applied across the marking surface 12. For example, a given spray nozzle 14 of the manifold 16 (e.g., the spray nozzle 14 located on the end of the manifold 16) may be initially located at a starting or reference position 40 on the marking surface 34 corresponding to a given location on the pixel data map 32. As shown in FIG. 2, such reference position 40 may, for example, correspond to a corner of the pixel data map 32. However, in other embodiments, the reference position 40 may correspond to any other suitable location on the pixel data map 32 (e.g., a center point of the pixel data map 32). Regardless, this reference position 40 may be utilized by the controller 22 to track the position of each spray nozzle 14 in relation to the pixel data map 32 as the manifold 16 is moved across the marking surface 12. For instance, in one embodiment, the reference position 40 may be designated by the controller 22 as the origin point and assigned the Cartesian coordinates (0, 0). Thus, the spray nozzle 14 positioned at the origin point may be assigned the coordinates (0, 0), with the remainder of the spray nozzles 14 being assigned coordinates based on their position relative to the origin point. For instance, assuming the spacing between each spray nozzle 14 corresponds to the pixel spacing, the coordinates of the remainder of the spray nozzles 14 may be (1, 0), (2, 0), (3, 0) . . . (n−1, 0), with n corresponding to the total number of the spray nozzles 14.

Thereafter, as the manifold 16 is moved relative to the reference position 40, the coordinates of the spray nozzles 16 may be incrementally changed and tracked relative to their position on pixel data map 32. For example, in the illustrated embodiment, as the manifold 16 is moved in the travel direction (indicated by arrow 42), the controller 22 may track the position of each spray nozzle 14 relative to the reference position 40 (via the measurements provided by the position sensor(s) 28) and control the valves 24 such that paint is discharged from each spray nozzle 14 as it passes over a location on the marking surface 12 having a corresponding location within the shaded portion 36 of the pixel data map 32. For instance, as shown in FIG. 2, a point 44 along the edge of the surface marking may, based on its mapped position on the surface 12, have the coordinates (x, y). Thus, as the manifold 16 is moved over the point 44, the spray nozzle 14 located at the coordinates (x, y) may be activated (i.e., by opening its corresponding valve 24) to begin spraying paint onto the marking surface 12. In such an embodiment, assuming that the travel direction 44 is perpendicular to the x-axis, the activated spray nozzle 14 may be de-activated (i.e., by closing its corresponding valve 24) as the manifold 16 moves over a point 46 along the opposed edge of the surface marking having the coordinates (x, y+z), wherein z corresponds to the height of the surface marking between the two points 44, 46 in the y-direction.

Such tracking/mapping of the position of the spray nozzles 14 relative to the pixel data map 32 may generally allow for the nozzles 14 to be controlled individually on a pixel-by-pixel basis. Accordingly, the nozzles 14 may be accurately controlled regardless of the manner in which the manifold 16 is moved across the marking surface 12. For instance, as indicated above, the controller 22 may, based on the information provided by the position sensor(s) 28, be configured to determine the position of each nozzle 14 along the marking surface 12 in relation to its corresponding location on the pixel data map 32. As such, if all or a portion the manifold 16 is moved over a portion of the surface 12 that has already been painted, the controller 22 may recognize that the nozzles 14 have already applied paint to such portion of the surface 12 and may appropriately deactivate the nozzles 14. However, as the manifold 16 is moved over portions of the surface 12 corresponding to pixels within the pixel data map 32 that have not yet been painted, the controller 22 may activate each nozzle 14 as it moves over a pixel location at which paint is to be applied.

As shown in FIG. 2, the manifold 16 defines a width 48 that is smaller than the overall width 50 of the surface marking. Thus, it should be appreciated that the manifold 16 may be required to make multiple, adjacent passes across the surface 12 to generate the entire surface marking. However, in alternative embodiments, the width of the manifold 16 may be selected such that the surface marking may be applied in a single pass across the marking surface 12. For instance, as will be described below with reference to FIGS. 6 and 7, two or more manifolds 16 may be assembled together to form a boom assembly having any suitable width.

Figure 3:
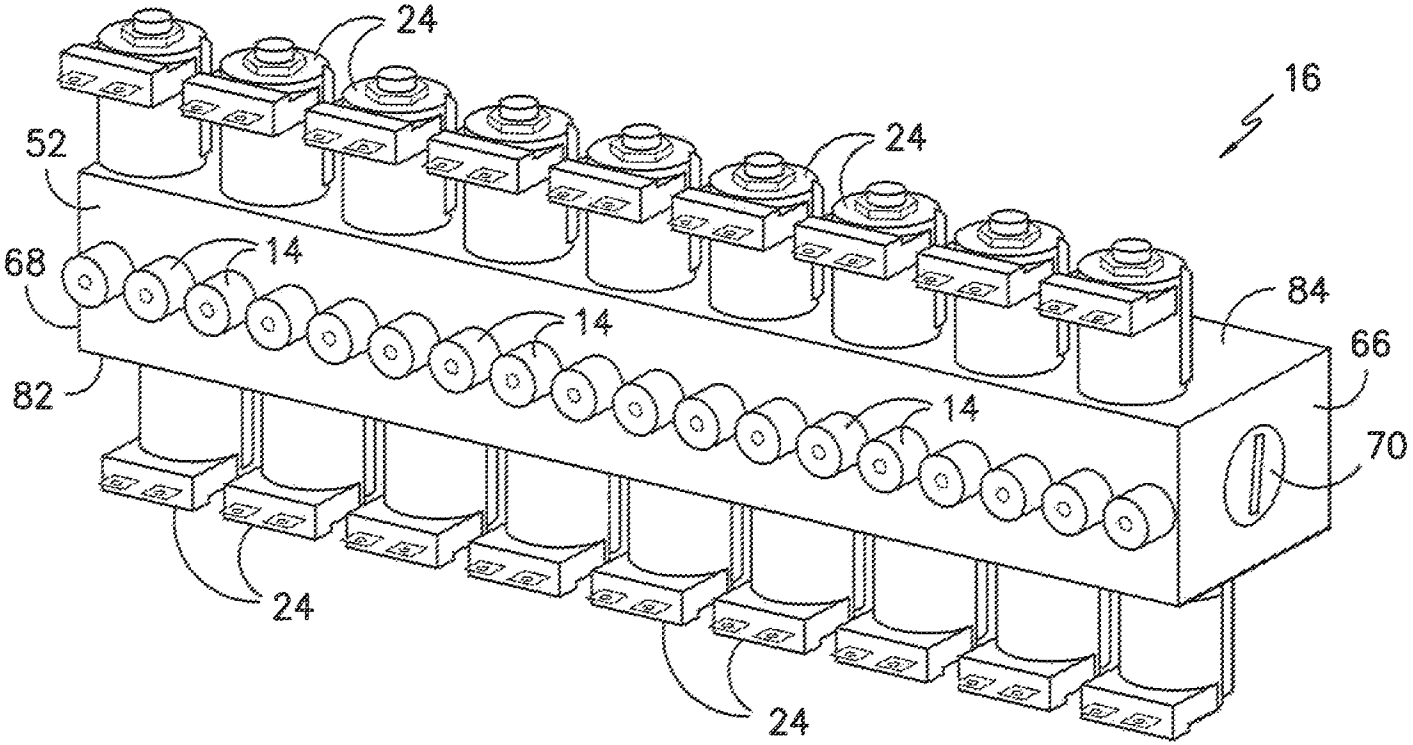
FIG. 3 illustrates a perspective view of one embodiment of a paint manifold that may be utilized with the disclosed system.
Figure 4:
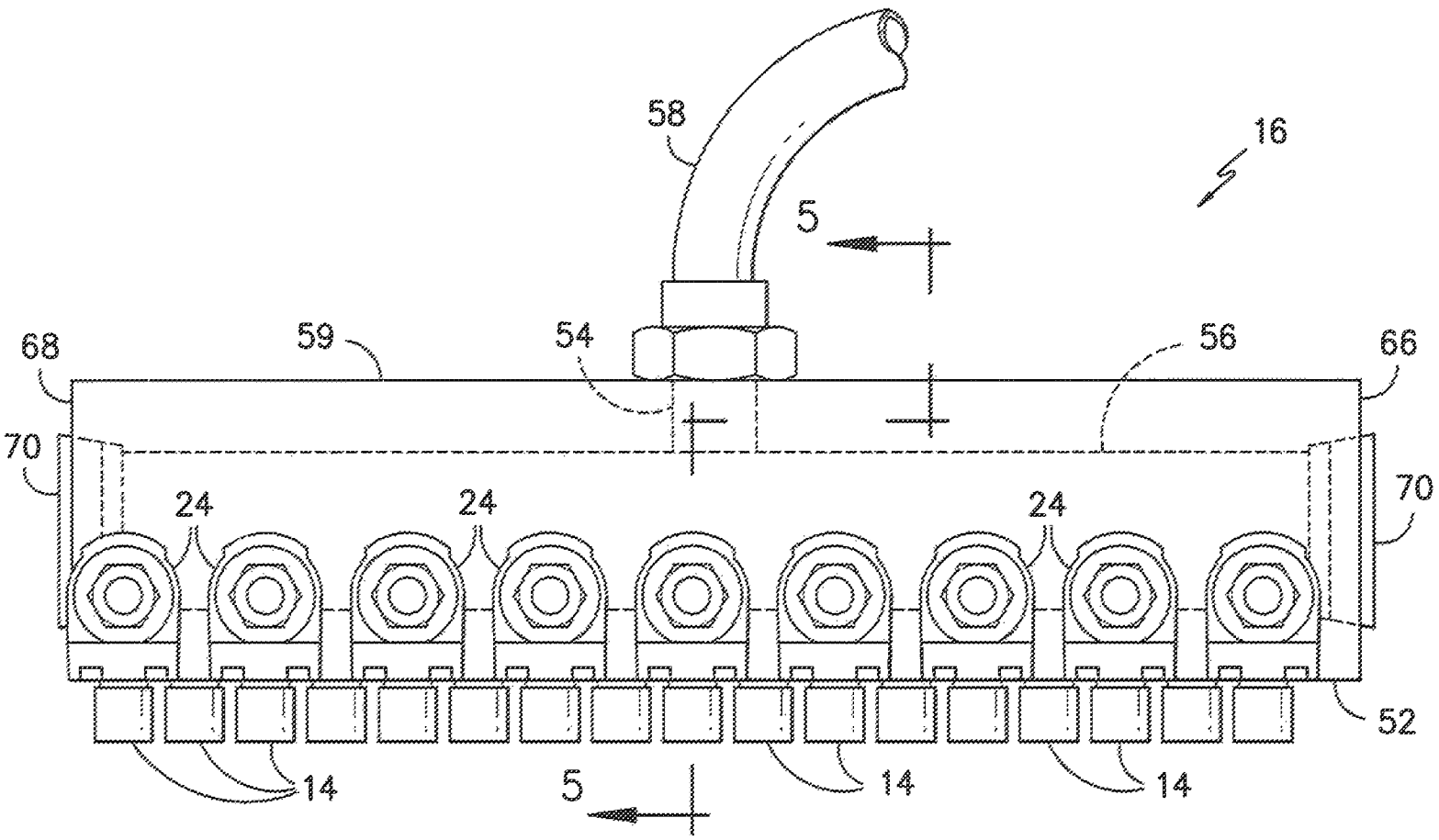
FIG. 4 illustrates a side view of the manifold shown in FIG. 3.
Figure 5:
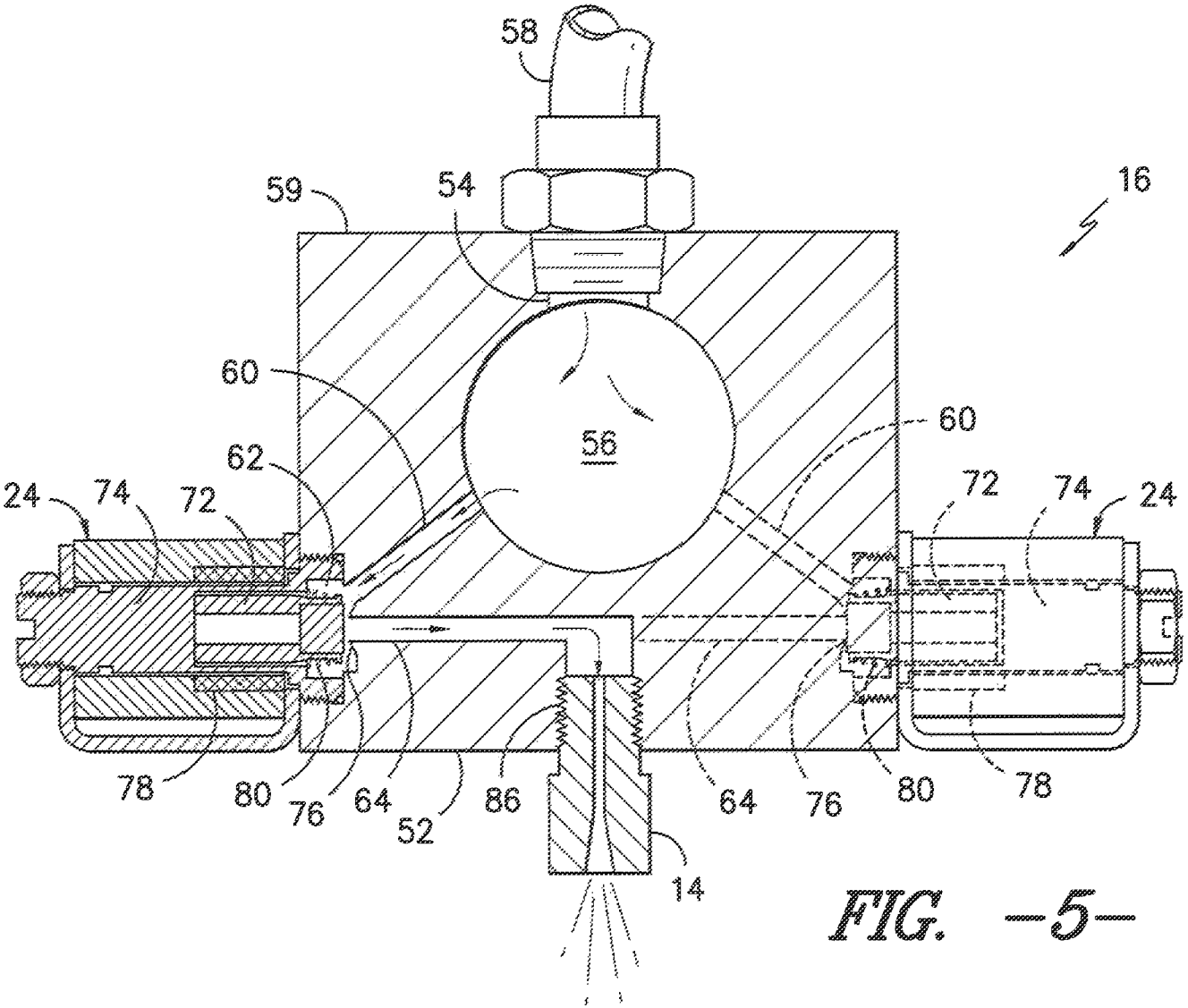
FIG. 5 illustrates a cross-sectional view of the manifold shown in FIG. 4 taken about line 5-5.

Referring now to FIGS. 3-5, one embodiment of a particular manifold configuration suitable for use with the disclosed system 10 is illustrated in accordance with aspects of the present subject matter. Specifically, FIG. 3 illustrates a perspective view of the manifold 16, particularly illustrating the manifold 16 oriented such that a bottom face 52 of the manifold 16 (i.e., where the spray nozzles 14 are located) is facing outwardly. Additionally, FIG. 4 illustrates a side view of the manifold 16 shown in FIG. 3 and FIG. 5 illustrates a cross-sectional view of the manifold 16 shown in FIG. 4 taken about line 5-5.

In general, the manifold 16 may have any suitable configuration/shape that permits it to receive and distribute paint to the spray nozzles 14 for subsequent discharge thereof. For example, as shown in FIGS. 3-5, that manifold 16 may be configured as an elongated member defining a generally rectangular cross-sectional shape. However, in other embodiments, the manifold 16 may define any other suitable cross-sectional shape.

The manifold 16 may generally define an inlet 54 through which paint may be supplied into a common passage 56 of the manifold 16 via a suitable tube, hose, pipe and/or other conduit 58. For example, as shown in the illustrated embodiment, the inlet 54 is defined through a top face 59 of the manifold 16. However, in other embodiments, the inlet 54 may be defined in the manifold 16 at any other suitable location that provides for fluid communication between the inlet 54 and the common passage 56.

The paint supplied into the inlet 54 may generally be directed through the common passage 56 and into a plurality of separate valve inlet channels 60 formed within the manifold 16, with each inlet channel 60 connecting the common passage 56 to a valve cavity 62 define between each valve 24 and the manifold 16. For example, as shown in FIG. 5, the paint flowing through the common passage 56 (indicated by the arrows) may be directed through the inlet channels 60 and into each valve cavity 62. Thereafter, when the valve 24 is in the opened position, the paint may be directed through a valve outlet channel 64 extending from each valve cavity 62 and into the corresponding spray nozzle 14.

It should be appreciated that the common passage 56 may generally be configured to extend any suitable length between a first end 66 and a second end 68 of the manifold 16. For example, in one embodiment, the common passage 56 may extend only partially between the first and second ends 66, 68 of the manifold 16. Alternatively, as shown in the illustrated embodiment, the common passage 56 may be configured to extend along the entire length of the manifold 16 and, thus, may be defined through the first and second ends 66, 68 of the manifold 16. In such an embodiment, as shown in FIGS. 3 and 4, suitable plugs or end caps 70 may be installed at each end 66, 68 of the common passage 16 in order to contain the paint flowing within the manifold 16. In addition, as will be described below with reference to FIGS. 6 and 7, by defining the common passage 56 through each end 66, 68 of the manifold 16, the manifold 16 may be assembled together with other manifolds 16 to form an elongated boom assembly.

As indicated above, the valves 24 associated with the manifold 16 may generally have any suitable valve configuration known in the art. For example, as shown in FIG. 5, in one embodiment, each valve 24 may include an actuator or poppet 72 movably disposed within a guide 74 between an opened position (as shown by the valve 24 on the left side of FIG. 4) and a closed position (as shown by the valve 24 on the right side of FIG. 4). Specifically, the poppet 72 may be configured to be linearly displaced within the guide 74 relative to a valve seat 76 formed at the interface defined between the valve cavity 62 and the outlet channel 64. Additionally, to move the poppet 72 relative to the valve seat 76, the valve 24 may also include a solenoid coil 78 located on and/or around the guide 74. As is generally understood, a current may be supplied to the coil 78 to generate a magnetic field that attracts the poppet 72 in a direction away from the valve seat 76. For instance, the disclosed controller 22 may include a square wave generator, a coil drive circuit or any other suitable device that is configured to apply a regulated current to the coil 78. Thus, by applying a current to the coil 78, the poppet 72 may be moved away from the valve seat 76, thereby opening the valve 24 and allowing paint to flow through the valve outlet channel 64 and into the corresponding spray nozzle 14. However, when the current is removed from the coil 78, the poppet 72 may be forced back into sealing engagement with the valve seat 76, thereby closing the valve 24. For example, as shown in FIG. 5, a biasing mechanism (e.g., a spring 80) may be disposed between the guide 74 and the poppet 72 in order to bias the poppet 72 into the closed position.

It should be appreciated that both the valves 24 and the spray nozzles 14 may generally be configured to be mounted to and/or within the manifold 16 using any suitable means and/or method known in that art. For example, as shown in FIG. 5, a portion of each valve 24 may be threaded (e.g., a portion of the guide 74) and may be configured to be received within a corresponding threaded valve opening (not shown) defined in the manifold 16, thereby allowing each valve 24 to be secured to the manifold 16. Similarly, in one embodiment, each spray nozzle 14 may include a threaded portion 86 configured to be received within a corresponding threaded nozzle opening (not shown) defined in the manifold 16. However, in other embodiments, the valves 24 and spray nozzles 14 may be mounted to and/or within the manifold 16 using any other suitable means and/or method known in the art, such as by welding and/or adhering the valves 24 and/or spray nozzles 14 to the manifold 16.

It should also be appreciated that the valves 24 may be coupled to the manifold 16 at any suitable location that permits the valves 24 to function as described herein. However, in a particular embodiment, the valves 24 may be mounted along each side of the manifold 16 in order to maximize the amount of spray nozzles 14 that can be installed onto the manifold 16. For example, it may often be the case that the diameter of the valves 24 is larger than the diameter of the spray nozzles 16. Thus, to minimize the spacing between each spray nozzle 14, the valves 24 associated with adjacent spray nozzles 14 may be positioned on opposed sides of the manifold 16. Specifically, as shown in FIG. 3, the valve 24 associated with the spray nozzle 14 positioned closest to the first end 66 of the manifold 16 may be positioned on a first side 82 of the manifold 16 while the valve 24 associated with the adjacent spray nozzle 16 may be positioned on a second side 84 of the manifold 16, with such a side-to-side, alternating pattern being used for each subsequent spray nozzle 14 disposed along the length of the manifold 16.

Figure 6:
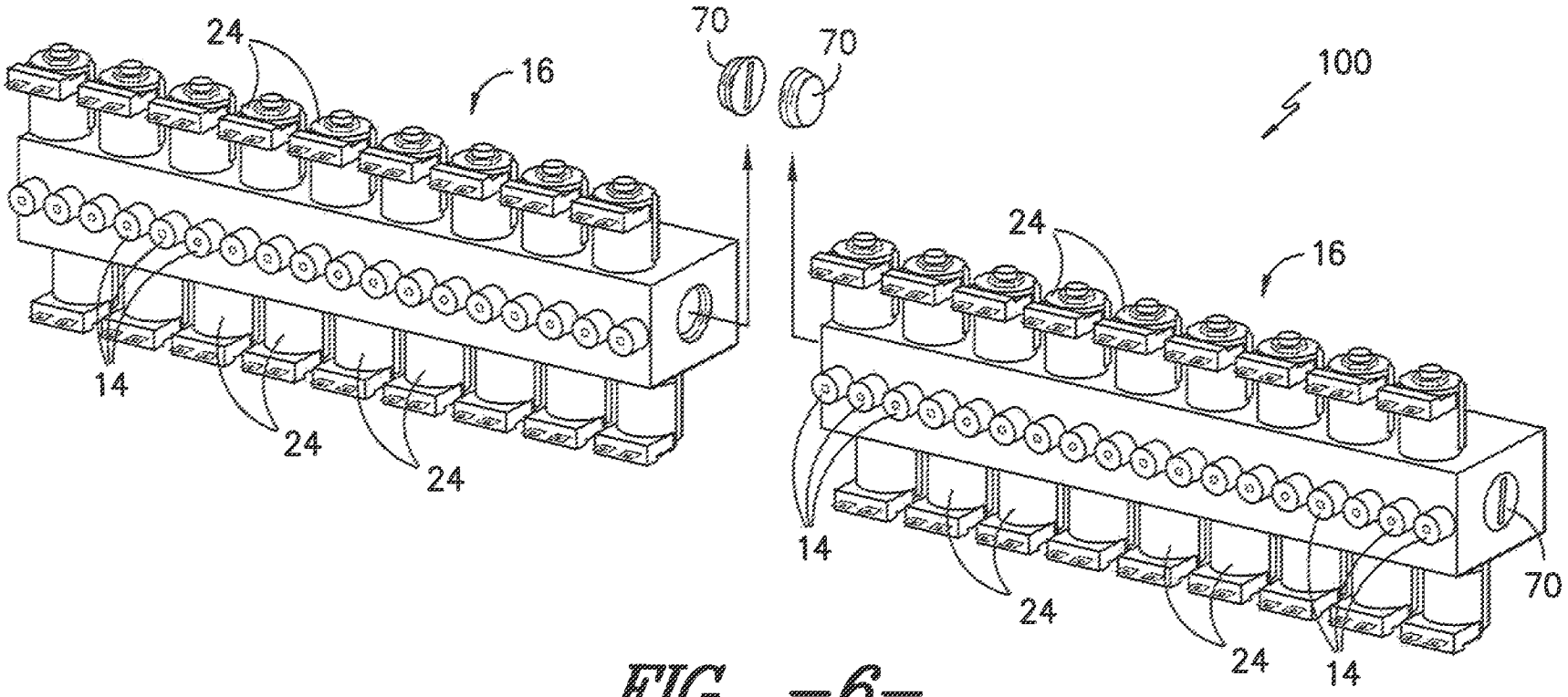
FIG. 6 illustrates an exploded view of one embodiment of a boom assembly in accordance with aspects of the present subject matter.
Figure 7:
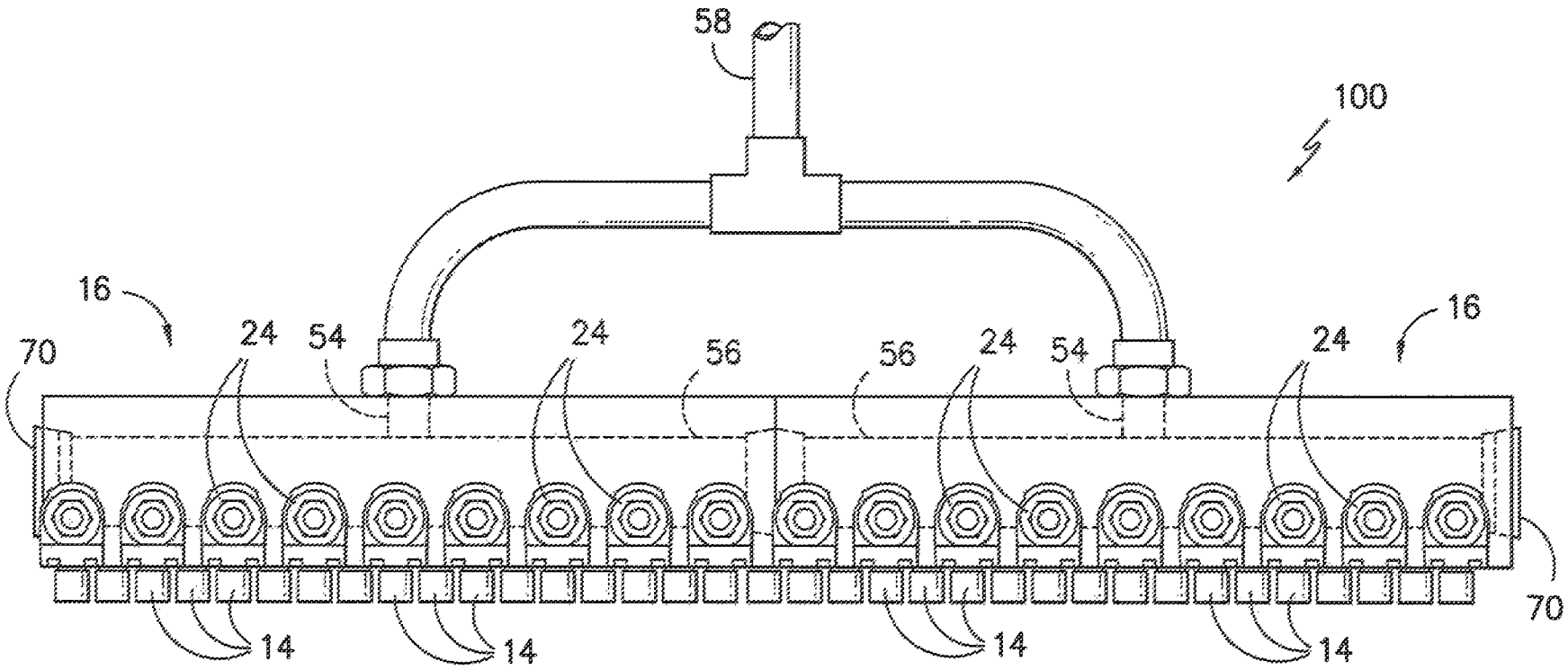
FIG. 7 illustrates a side view of the boom assembly shown in FIG. 6.

As indicated above, in several embodiments, the disclosed manifold 16 may be configured to form part of a modular boom assembly. Specifically, as shown in FIGS. 6 and 7, two or more manifolds 16 may be connected end-to-end to form a larger boom assembly 100. To assemble the boom assembly 100, the end caps 70 positioned at the adjacent ends of the manifolds 16 may be removed and the manifolds 16 may be coupled together (e.g., using one or more fastening mechanisms, such as bolts, screws, pins, brackets and/or the like or by welding and/or adhering the manifolds 16 together) such that the common passages 56 of the manifolds 16 are in fluid communication with one another, thereby allowing the paint supplied to the manifolds 16 to flow along the entire length of the boom assembly 100. For instance, as shown in FIG. 7, in one embodiment, each manifold 16 of the boom assembly 100 may be supplied paint through its inlet 54 via a separate or shared conduit 58. Alternatively, paint may only be supplied to one of the manifolds 16, with the remaining manifolds 16 receiving paint via the interconnected common passages 56.

Such a modular configuration may generally allow for the disclosed manifolds 16 to be used to efficiently and effectively apply surface markings have any suitable width. For example, a single manifold 16 may be utilized to apply narrow surface markings (e.g., lines or stripes). However, for wider surface markings (e.g., logos, designs and/or other indicia), two or more manifolds 16 may be assembled together to increase the efficiency in which the surface marking(s) may be applied to a given surface 12. For example, to form a surface marking having a width of 10 feet, a plurality of manifolds 16 may be assembled together to form a ten foot wide (or larger) boom assembly 100, thereby allowing for the surface marking to be applied by making a single pass across the marking surface 12. Alternatively, a smaller boom assembly 100 may be utilized to generate the same surface marking by making several adjacent passes across the marking surface 12.

Figure 8:
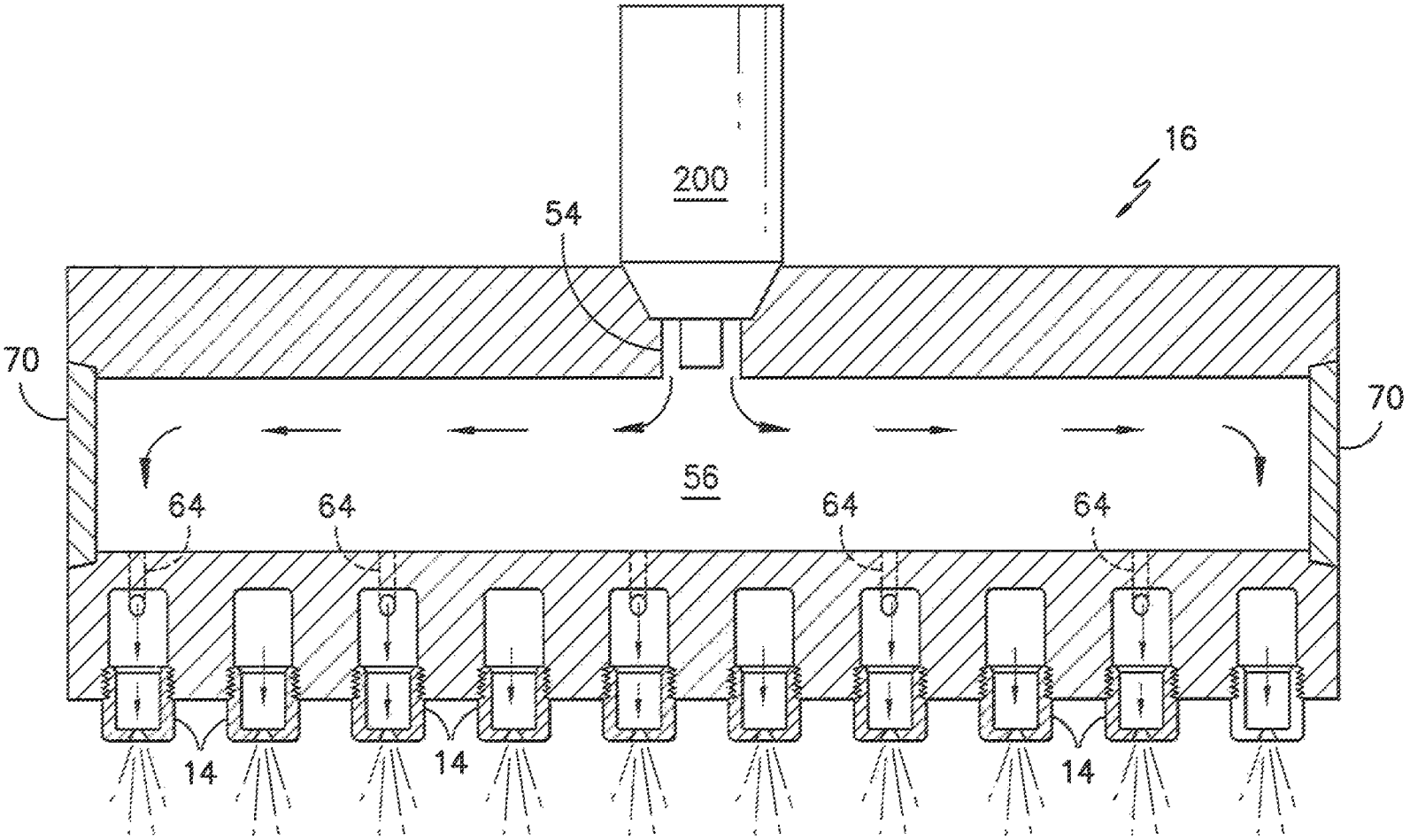
FIG. 8 illustrates a cross-sectional view of another embodiment of a manifold that may be utilized with the disclosed system, particularly illustrating the manifold being supplied paint from a pressurized paint source.

Additionally, as described above, in several embodiments, the paint supplied to the manifold(s) 16 may be pressurized via one or more suitable pumps 20. For example, as shown in FIG. 1, paint may be pumped into the manifold(s) 16 from a suitable, non-pressurized container 18. Alternatively, paint may be supplied to the manifold(s) 16 via a pressurized, paint containing vessel. For instance, FIG. 8 illustrates a side, cross-sectional view of a manifold 16 having a pressurized paint source 200 in fluid communication with its inlet 54. As shown in FIG. 8, in one embodiment, the pressurized paint source 200 may comprise a spray paint or aerosol can. In such an embodiment, the manifold 16 may be configured such that, when the aerosol can 200 is screwed into or otherwise positioned within the inlet 54, a valve or other suitable device associated with the aerosol can 200 may be compressed or actuated, thereby allowing the pressurized paint contained within the can 200 to fill the common passage 56 and inlet channels 60 (FIG. 5) of the manifold 16. Thereafter, the valves 24 associated with the spray nozzles 14 may be selectively actuated to provide a controlled release of the pressurized paint through the spray nozzles 14. Once the pressurized paint has been discharged from the manifold 16, the used aerosol can 200 may then be removed and replaced with a new aerosol can 200 to allow for additional spraying.

It should be appreciated that, as an alternative to aerosol cans, any other suitable pressurized, paint containing vessel may be used to supply pressurized paint to the manifold 16. For instance, a pressurized tank may be coupled to the manifold 16 via a suitable hose, pipe and/or other conduit.

Additionally, it should be appreciated that the above-described manifold configurations may generally allow for a single colored paint to be applied by a given manifold 16. However, in alternative embodiments, the disclosed manifold 16 may be configured to apply a plurality of different colored paints to a given marking surface 12, thereby allowing for the creation of multi-colored surface markings using a single manifold 16 or boom assembly 100. For example, FIG. 9 illustrates a cross-sectional view of one embodiment of a manifold 16 that is capable of receiving and spraying a plurality of different colored paints.

As shown in FIG. 9, instead of defining a single common passage 56 configured to receive a single colored paint, the manifold 16 may define a plurality of common passages 300, 302, 304, 306, 308 configured to receive a plurality of different colored paints. Specifically, in the illustrated embodiment, the manifold 16 defines five pairs of common passages (e.g., a first pair of common passages 300, a second pair of common passages 302, a third pair of common passages 304, a fourth pair of common passage 306 and a fifth pair of common passages 308), with each pair of common passages 300, 302, 304, 306, 308 being configured to receive a different colored paint. For instance, three of the pairs of common passages (e.g., the first, second and third pairs of common passages 300, 302, 304) may be configured to receive the three primary colors (e.g., cyan, magenta and yellow using the CMY color scale or red, yellow and blue using the RYB color scale) and the remaining two pairs of common passages (e.g., the fourth and fifth pairs of common passages 306, 308) may be configured to receive black and white colored paints. Alternatively, each pair of common passages 300, 302, 304, 306, 308 may be configured to receive any other suitable colored paint. Moreover, in further embodiments, it should be appreciated that the manifold 16 may define any other suitable number of common passages, with each common passage (or pair of common passages) being configured to receive any suitable colored marking fluid. For example, in addition to or as an alternative to receiving different colored paints, the common passages 300, 302, 304, 306, 308 may be configured to receive different colored pigments.

Similar to the embodiment described above with reference to FIG. 5, a plurality of separate valve inlet channels 360 may be in flow communication with each common passage 300, 302, 304, 306, 308, with each inlet channel 360 connecting one of the common passages 300, 302, 304, 306, 308 to a valve cavity 362 defined between the manifold 16 and each valve 24. For example, as shown in FIG. 9, the paint flowing through the common passages 300, 302, 304, 306, 308 may be directed through each valve inlet channel 360 and into each valve cavity 362. Thereafter, when the corresponding valve 24 is opened, the paint may be discharged from each valve cavity 362 through a valve outlet channel 364 extending from each valve position. However, unlike the embodiment described with reference to FIG. 5, each of the outlet channels 364 associated with a given spray nozzle 14 may be in flow communication with a mixing passage 390 defined within the manifold 16. As such, paint directed through the outlet channels 364 associated with a spray nozzle 14 may be directed through the mixing passage 390 prior to being discharged from the spray nozzle 14.

By connecting each of the valve outlet channels 364 supplying paint to a particular spray nozzle 14 via a common mixing passage 390, two or more of the corresponding valves 24 may be activated at any given time in order to mix two or more of the colors received within the common passages 300, 302, 304, 306, 308, thereby allowing a plurality of different colors to be created for subsequent discharge from the spray nozzle 14. Thus, assuming that the first, second and third pairs of common passages 300, 302, 304 are configured to received cyan, magenta and yellow colored paints, respectively, the corresponding valves 24 may be selectively activated to permit such colored paints to be combined within the mixing passage 390 to create any number of different colors. For instance, by activating the valves 24 associated with the first and third pairs of common passages 300, 304, cyan and yellow colored paints may be delivered to and subsequently mixed within the associated mixing passage 390, thereby creating a green colored paint to be discharged from the spray nozzle 14.

It should be appreciated that the mixing passage 390 and/or spray nozzles 14 may include any suitable features and/or have any suitable configuration that facilitates and/or enhances mixing of the different colored paints. For example, in one embodiment, the mixing passage 490 and/or each nozzle 14 may include a Venturi through which the different colored paints are directed. In such an embodiment, the Venturi and supporting structure may be configured to create turbulent conditions within the mixing passage 390 and/or nozzles 14, thereby ensuring proper mixing of the paints. In addition to mixing different colored paints, a Venturi or other mixing feature may also be utilized to mix paint with one or more different colored pigments. For example, in one embodiment, white paint may be supplied into the mixing passage 390 together with a specific colored pigment (e.g., a blue pigment). In such an embodiment, the Venturi or other mixing feature may facilitate mixing of the paint and pigment in order to create the desired paint color (e.g., a blue colored paint). A suitable nozzle configuration including a Venturi is disclosed in U.S. Pat. Pub. No 2009/0134237 (Giles), filed on Nov. 18, 2008 and entitled "System and Method for At-Nozzle injection of Agrochemicals," the disclosure of which is hereby incorporated by reference herein in its entirety for all purposes.

It should also be appreciated that the valves 24 may be controlled in a manner that allows for the quantity of each colored paint supplied into the mixing passage 390 to be regulated, thereby increasing the number of different shades of colors that may be created within the manifold 16. For instance, in several embodiments, each valve 24 may be configured to be throttled in a manner that allows for precise control of the quantity of colored paint supplied to the mixing passage 390. Specifically, each valve 24 may be configured to be partially opened by carefully controlling the distance that the poppet 72 (FIG. 5) is moved relative to the valve seat 76 (FIG. 5), thereby providing for a regulated amount of colored paint to be discharged into the corresponding outlet channel 364 for a given valve pulse. As is generally understood, the position of the poppet 72 relative to the valve seat 76 may be regulated by manipulating the forces acting on the poppet 72, with a steady throttling position resulting from equilibrium of the forces. For instance, in the illustrated embodiment, forces from the spring 80 (FIG. 5), the pressurized paint and the solenoid coil 78 (FIG. 5) may act on the poppet 72 simultaneously. In particular, the forces from the spring 80 and the paint may tend to bias the poppet 72 in the direction of the valve seat 76 while the force from the coil 78 may tend to bias the poppet 72 in the opposite direction. Thus, by carefully controlling the force applied on the poppet 72 by the coil 78 (i.e., by regulating the amount of current supplied to the coil 78), an equilibrium of the forces acting on the poppet 72 may be achieved, thereby allowing the poppet 72 to be moved to the appropriate position for supplying a given amount of colored paint into the mixing passage 390. Suitable valve configurations and control methods for throttling a solenoid valve are generally disclosed in U.S. patent application Ser. No. 13/410,589 (Needham et al), filed on Mar. 2, 2012 and entitled "Electrically Actuated Valve for Control of Instantaneous Pressure Drop and Cyclic Durations of Flow," the disclosure of which is hereby incorporated by reference herein in its entirety for all purposes.

Accordingly, in the embodiment shown in FIG. 9, the valves 24 associated with a given spray nozzle 14 may be controlled such that the particular color and amount of paint supplied to the mixing passage 390 is regulated, thereby permitting various different colors to be created within the manifold 16. Moreover, since each spray nozzle 14 may include a separate mixing passage 390 associated therewith (e.g., the valves 24 on the right side of FIG. 9 may control the paint supplied to one mixing passage 390 while the valves 24 on the left side of FIG. 9 may control the paint supplied to a separate, adjacent mixing passage 390), the number of different colored paints that may be sprayed from the manifold 16 at any given time is only limited by the number of spray nozzles 14 installed onto the manifold 16.

It should be appreciated that, with the manifold configuration shown in FIG. 9, the different colored paints may, for example, be supplied to the manifold 16 via separate manifold inlets (not shown), with each inlet being in fluid communication with one of the pairs of common passages 300, 302, 304, 306, 308. In such an embodiment, each inlet may be supplied paint from any suitable paint source, such as the container/pump 18, 20, combination shown in FIG. 1 and/or the pressurized paint source 200 shown in FIG. 8.

Moreover, it should be appreciated that multi-colored surface markings may be applied using the disclosed manifolds 16 is in a variety of different ways. For example, FIG. 10 illustrates another example of pixel data map 32 having a surface marking (e.g., a wheelchair sign) that includes a first shaded portion 402 designed to be painted a first color (e.g., white) and a second shaded portion 404 designed to be painted a second color (e.g., blue). In one embodiment, as indicated above, the illustrated surface marking may be applied with the manifold 16 shown in FIG. 9, wherein different colored paints may be supplied to each spray nozzle 14. Alternatively, as shown in FIG. 10, the system 10 may include a first manifold 16A configured to receive a first colored paint from a first paint source 406 (e.g., from a tank/pump combination and/or a pressurized paint source) and a second manifold 16B configured to receive a second colored paint from a second paint source 408 (e.g., from a tank/pump combination and/or a pressurized paint source). In such an embodiment, both manifolds 16A, 16B may be configured to be moved across the marking surface 12 (e.g., a parking lot) such that the first manifold 16A may apply the first colored paint to the portion of the surface 12 corresponding to the first shaded portion 402 of the pixel data map 32 and the second manifold 16B may apply the second colored paint to the portion of the surface 12 corresponding to the second shaded portion 404 of the pixel data map 32.

It should be appreciated that, although FIG. 10 illustrates the disclosed system 10 as including two manifolds 16A, 16B, the system 10 may generally include any number of manifolds 16 configured to receive any number of different colored paints. For instance, if the surface marking to be applied includes three different colors, the system 10 may include three separate manifolds, with each manifold being configured to apply a different color to the surface 12 being marked.

It should also be appreciated that any or all of the components of the disclosed system 10 may be configured to be mounted to any suitable frame, vehicle and/or the like that allows for such components to be moved relative the surface 12 to be marked. For example, FIG. 11 illustrates one embodiment of a movable cart 500 that may be used to support the various components of the disclosed system 10. As shown, the cart 500 includes a frame 502 supported relative to the ground by a plurality of wheels 504. In general, the frame 502 may have any suitable configuration that permits it to support one or more of the components of the disclosed system 10. For example, as shown in FIG. 11, the frame 502 defines a generally rectangular shape. However, in other embodiments, the frame 502 may define any other suitable shape.

In several embodiments, one or more manifolds 16 may be mounted to a portion of the frame 502 in a manner that permits the paint supplied to the manifold(s) 16 (e.g., via the conduit 58) to be sprayed onto the marking surface 12. As shown in FIG. 11, in one embodiment, the manifold(s) 16 may be mounted at a back end 506 of the frame 502 at a location behind the back wheels 504 such that, as the cart 500 is moved in the travel direction 42, paint may be applied to the marking surface 12 via the spray nozzles 14 after the wheels 504 have moved across such surface. In such an embodiment, the total width 48 of the manifold(s) 16 may be larger than the width of the wheel base (i.e., the distance defined between each pair of wheels 504) so that multiple, adjacent passes may be made with the cart 500 without moving the wheels 504 across any previously painted surface. However, in other embodiments, the manifold(s) 16 may be mounted to frame 502 at any other suitable location. Additionally, as indicated above, any other component of the system 10 may also be mounted to or otherwise supported by the frame 502. For example, as shown in FIG. 11, the controller 22, the fluid container 18 and/or the pump 20 may also be mounted to and/or otherwise supported by the frame 502.

In several embodiments, the cart 500 may be configured to be manually pushed and/or pulled across the surface 12 to be marked. In such embodiment, the cart 500 may include a suitable handle 508 coupled to and/or extending outwardly from the frame 602 to allow an operator to easily and efficiently push and/or pull the cart across the surface 12. Alternatively, the cart 500 may be configured to be pulled behind a vehicle, such as a truck, lawnmower, four-wheeler and/or other vehicle. In such an embodiment, a suitable hitch and/or other coupling may be mounted to the frame 502 to permit the cart 500 to be coupled to the vehicle. In further embodiments, the cart 500 may be configured to be moved or otherwise driven automatically. For example, the front and/or back pair of wheels 504 may be configured as drive wheels and, thus, may be coupled to suitable electronic motors. In such an embodiment, the controller 22 may be configured to control the operation of each motor such that the cart 500 is automatically moved across the surface 12.

It should be appreciated that, in addition to being configured to be moved across a generally horizontal surface, the disclosed cart 500 may also be configured to be moved across a generally vertical surface. For example, to apply a surface marking to the side of a building or other suitable wall, the cart 500 may be configured tip be coupled to suitable cables and/or other suspension devices such that the cart 500 may be raised and/or lowered relative to the vertical surface.

It should also be appreciated that, as an alternative to fixedly mounting the manifold 16 onto the cart 500, the manifold 16 may be coupled to the cart 500 in a manner that allows for the position of the manifold 16 to be adjusted independent of the cart 500. For example, in one embodiment, the manifold 16 may be coupled to positioning arms, slide rods, cylinders and/or any other suitable means that allows the position of the manifold 16 to be adjusted forward/back and/or left/right relative to the cart 500.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for applying multi-colored surface markings to a surface using a first manifold configured to receive a first colored marking fluid and a second manifold configured to receive a second colored marking fluid, the first and second manifolds each including a plurality of spray nozzles and a plurality of valves, each valve being configured to regulate the flow of marking fluid from a respective one of the spray nozzles, the method comprising:

receiving, at a controller communicatively connected to the valves, a pixel data map associated with a desired surface marking to be applied across an area of the surface, the surface marking including a first portion to be applied using the first colored marking fluid and a second portion to be applied using the second colored marking fluid;

scaling the pixel data map based on the dimensions of the desired surface marking and a resolution capability of the first and second manifolds;

controlling, via the controller, the operation of the valves of the first manifold as the first manifold is moved along the surface such that the first colored marking fluid is discharged from the spray nozzles of the first manifold in a manner that generates the first portion of the desired surface marking across the surface; and controlling, via the controller, the operation of the valves of the second manifold as the second manifold is moved along the surface such that the second colored marking fluid is discharged from the spray nozzles of the second manifold in a manner that generates the second portion of the desired surface marking across the surface.

2. The method of claim 1 further comprising sensing, using a position sensor, the position of the first manifold as the first manifold is moved along the surface.

3. The method of claim 2 further comprising locating each of the spray nozzles of the first manifold relative to the surface and correlating the location of the spray nozzles to pixels on the pixel data map.

4. The method of claim 3, wherein controlling the operation of the valves of the first manifold includes individually activating each valve of the first manifold when the associated spray nozzle of the first manifold passes over a location on the surface at which the first colored marking fluid is to be applied.

5. The method of claim 3, wherein controlling the operation of the valves of the first manifold further includes individually deactivating each valve of the first manifold when the associated nozzle of the first manifold passes over a location on the surface at which the first colored marking fluid is not to be applied.

6. The method of claim 1, wherein each valve of the first manifold includes a poppet movable between an opened position and a closed position, and wherein controlling the operation of the valves of the first manifold includes controlling a current supplied to the valve to selectively move the poppet between the opened and closed positions.

7. The method of claim 6 wherein the poppet sealingly engages a valve seat defined by the respective manifold when the poppet is in the closed position.

8. The method of claim 1 further comprising connecting a source of first marking fluid to the first manifold and connecting a source of second marking fluid to the second manifold.

9. The method of claim 1, wherein the first and second manifolds are mounted to a frame, wherein the method further comprises moving the frame along the surface.

10. The method of claim 9 further comprising sensing a position of the frame along the surface using at least one of a wheel encoder, a GPS receiver, and a camera.

11. A system for applying multi-colored surface markings to a surface, the system comprising:

a first manifold configured to receive a first colored marking fluid;

a second manifold configured to receive a second colored marking fluid, the first and second manifolds each including a plurality of spray nozzles and a plurality of valves, each valve being configured to regulate the flow of marking fluid from a respective one of the spray nozzles; and a controller communicatively coupled to the valves, the controller configured to:

receive a pixel data map associated with a desired surface marking to be applied across an area of the surface, the surface marking including a first portion to be applied using the first colored marking fluid and a second portion to be applied using the second colored marking fluid;

scale the pixel data map based on the dimensions of the desired surface marking and a resolution capability of the first and second manifolds;

control the operation of the valves of the first manifold as the first manifold is moved along the surface such that the first colored marking fluid is discharged from the spray nozzles of the first manifold in a manner that generates the first portion of the desired surface marking across the surface; and control the operation of the valves of the second manifold as the second manifold is moved along the surface such that the second colored marking fluid is discharged from the spray nozzles of the second manifold in a manner that generates the second portion of the desired surface marking across the surface.

12. The system of claim 11 further comprising a position sensor configured to sense the position of the first manifold as the first manifold is moved along the surface.

13. The system of claim 12, wherein the controller is further configured to locate each of the spray nozzles of the first manifold relative to the surface and correlate the location of the spray nozzles to pixels on the pixel data map.

14. The system of claim 13, wherein the controller is further configured to individually activate each valve of the first manifold when the associated nozzle of the first manifold passes over a location on the surface at which the first colored marking fluid is to be applied.

15. The system of claim 13, wherein the controller is further configured to individually deactivate each valve of the first manifold when the associated nozzle of the first manifold passes over a location on the surface at which the first colored marking fluid is not to be applied.

16. The system of claim 11, wherein each valve of the first manifold includes a poppet movable between an opened position and a closed position.

17. The system of claim 16, wherein the poppet sealingly engages a valve seat defined by the respective manifold when the poppet is in the closed position, and the poppet is spaced from the valve seat when the poppet is in the opened position.

18. The system of claim 11 further comprising a source of first marking fluid connected to the first manifold and a source of second marking fluid connected to the second manifold.

19. The system of claim 11, wherein the first and second manifolds are mounted to a frame configured to move along the surface.

20. The system of claim 19 further comprising a sensor configured to sense a position of the frame along the surface, the sensor including at least one of a wheel encoder, a GPS receiver, and a camera.

* * * * *